United States Patent [19]

Gough

[11] 4,121,650

[45] Oct. 24, 1978

[54] FOUNDRY CASTING MACHINES

[75] Inventor: George Terah Gough, Newcastle, England

[73] Assignee: Gough & Company (Hanley) Limited, Stoke on Trent, England

[21] Appl. No.: 792,248

[22] Filed: Apr. 29, 1977

[30] Foreign Application Priority Data

Jan. 15, 1976 [GB] United Kingdom ..... 24734/76

[51] Int. Cl.[2] ..... B22D 5/04; B65G 47/02

[52] U.S. Cl. ..... 164/329; 164/324; 164/5; 214/16.4 R

[58] Field of Search ..... 164/162, 172, 173, 182, 164/207, 5, 324, 329, 326, 327, 328, 386, 387, 392, 412

[56] References Cited

U.S. PATENT DOCUMENTS

| | | | |
|---|---|---|---|
| 1,123,914 | 1/1915 | Mumford | 164/5 |
| 2,843,895 | 7/1958 | Hallsworth | 164/327 |
| 3,508,598 | 4/1970 | York | 164/137 X |
| 3,576,246 | 4/1971 | Hulet et al. | 164/324 X |

FOREIGN PATENT DOCUMENTS

| | | | |
|---|---|---|---|
| 1,302,390 | 1/1973 | United Kingdom | 164/131 |

*Primary Examiner*—Francis S. Husar

*Assistant Examiner*—John S. Brown

*Attorney, Agent, or Firm*—Charles E. Brown

[57] ABSTRACT

A foundry casting machine comprising an endless conveyor supported on a frame within an overall casing for movement in a vertical plane through a sinuous path, the casing having a first opening therein so that trays supported by the conveyor, as they move past said first opening can have moulds assembled thereon, a second opening in the casing at a pouring station to enable molten metal to be poured into the moulds and a third opening in the casing through which the contents of the trays may be removed, air extraction means for withdrawing undesirable gases and air-borne particles from the interior of the casing and means to hold together the parts of the mould prior to the pouring of the molten metal, said means comprising either one or more weights which are automatically placed upon the moulds prior to a pouring operation and are removed from the moulds subsequent to the pouring operation or clamping devices supported on the trays, the clamping devices being suitable either for clamping together mould parts which are split horizontally or for clamping together mould parts which are split vertically. The machine is specifically designed for handling green sand moulds.

14 Claims, 8 Drawing Figures

1
3
9
13
15
17
21
27
31
33
35
37
39
43
45
47
49
51
53
55
57
59
61
63
65
67

FOUNDRY CASTING MACHINES

This invention relates to a foundry casting machine and in particular to foundry apparatus in which sand moulds are assembled on trays which are supported on an endless conveyor and are then passed semi-automatically from a tray-loading station to a casting station. Here, the moulds are filled with molten metal and are then passed through the machine to enable the molten metal to solidify and cool somewhat until they arrive at a discharge station where the moulds are automatically tipped from the trays or removed by hand, dependent on size and shape, and the castings and moulding sand are automatically processed so that the sand can be re-processed and then re-used and the castings recovered.

A foundry casting machine of the general type described above is disclosed in the complete specification of our British Pat. No. 1,302,390 and the present invention is a modification of that machine. In claim 1 of the complete specification of our Pat. No. 1,302,390, there is claimed a casting machine comprising a chain type conveyor supporting suspended trays or containers for movement in a vertical plane through a convoluted path within an overall casing, the path being such as to convey the trays or containers successively past three openings in the exterior of the casing, comprising a first opening providing access to successive trays or containers for the assembly of moulds therein, a second opening providing access to the trays or containers for the pouring of molten metal into the moulds, and a third opening through which the contents of the trays or containers may be discharged, means being provided to tip the trays or containers as they pass this opening, and air extraction means adapted to withdraw air from the interior of the casing and from the vicinity of the second and third openings for passage through a filtration plant.

The machine disclosed in our above-identified complete specification is designed for handling moulds formed of resin coated sand which are self-sufficient and self-supporting and which, after pouring of the molten metal, tend to disintegrate after a predetermined period of time. Such moulds are known as shell moulds. The machine of the present invention has been designed to handle "green" sand moulds which need not necessarily have mould boxes, but may have. Such moulds without boxes are known as flaskless green sand moulds. When there is no mould box, the mould is relatively light and as molten metal is poured into it, there is a tendancy for the mould to burst open. In order to prevent this, we have therefore designed a machine which automatically places weights on top of the moulds prior to a pouring operation, and removes them after initial cooling, or clamps the moulds as required.

According to the broadest aspect of the present invention, we provide a foundry casting machine comprising an endless conveyor supporting suspended trays for movement in a vertical plane through a sinuous path within an overall casing, the path being such as to convey the trays successively past three openings in the exterior of the casing, comprising a first opening providing access to successive trays for the assembly of one or more moulds therein, a second opening at a pouring station providing access to the trays for the pouring of molten metal into the moulds, and a third opening through which the contents of the trays may be removed, air extraction means adapted to withdraw air and air-borne particles from the interior of the casing and from the vicinity of the second and third openings for passage through a filtration plant, and means to hold together the mould parts prior to a pouring operation.

In a preferred construction, the means to hold together the mould parts comprises one or more weights, and the machine therefore includes a weight transfer device to place one or more weights on top of the mould prior to a pouring operation, and to remove the weight(s) from the mould subsequent to the pouring operation.

It is envisaged however, that the mould(s), instead of being split horizontally, may be split vertically into two mould halves, in which case, the means to hold together the mould parts would comprise clamps. These could be located on the trays, could be mechanically, hydraulically or pneumatically operated, and could be operated by the operator at the first opening, and could be unlatched by a cam type device before the moulds are removed from the trays.

Preferably, moulds are removed automatically from the trays at the third opening, and means is provided at the third opening to tip the trays over as they pass the opening.

It is preferred that the conveyor for the mould trays has a horizontal lower run extending beneath, round and over a pair of sprocket wheels at the pouring station and the conveyor may then return parallel to the lower run and beneath and round a further pair of sprocket wheels and then continue vertically upwards, the pouring occurring at the outermost extent of the pair of sprocket wheels.

Preferably, said weight transfer device places a weight onto each mould on the trays as they pass along the lower conveyor run and subsequently removes the weight from the cast moulds as they enter a section of vertical conveyor run, preferably that referred to previously. The section of vertical conveyor run need not necessarily be the first section of the "return" run. The length of return run could be adjustable according to the length of cooling time required.

In a particular arrangement, the weight transfer device for placing the weights on the moulds and removing the weights from the moulds comprises a forklift type unit having a horizontal guide track for supporting a horizontally movable carriage, and a vertically extending mast supported by said carriage in which lifting means supported on a vertically movable carriage can move. Preferably, said lifting means comprises a pair of lifting forks. Preferably, the weight transfer device is located so that its horizontal guide track extends towards the sprocket wheels at the pouring station and its mast extends parallel to said vertical conveyor run and it is so arranged that, in a typical operating sequence with the conveyor stationary, the vertically extending carriage will rise from its lowermost position to an upper position whereupon the horizontally movable carriage will be moved forwards so that the lifting means, e.g. forks, can be moved into engagement with suitable hoops on weights located on the moulds on a tray moving up the vertically extending run of the conveyor, whereupon the vertically movable carriage will be moved upwards to an uppermost position to remove the weights from the moulds, and the horizontally movable carriage will then be returned to its initial position to move the weights out of the path of the conveyor, the vertically movable carriage then being lowered to its original position so as to place the weight on another mould located beneath it on the horizontal run of the conveyor. The conveyor is then automatically indexed forward to remove the weights from off the lifting forks, whereupon the cycle of operations is repeated.

Preferably, the horizontally and vertically movable carriages are operated by double acting single step hydraulic lifting and traversing rams but it will be appreciated that chain drives, ropes, screws or any other known means may be used. Furthermore, it will be appreciated that instead of using a forklift type unit, alternative systems could be used, such as, for example, an electro-magnetic head in place of the lifting forks.

Several embodiments of the invention are now described with reference to the accompanying drawings, in which.

Figure 1:
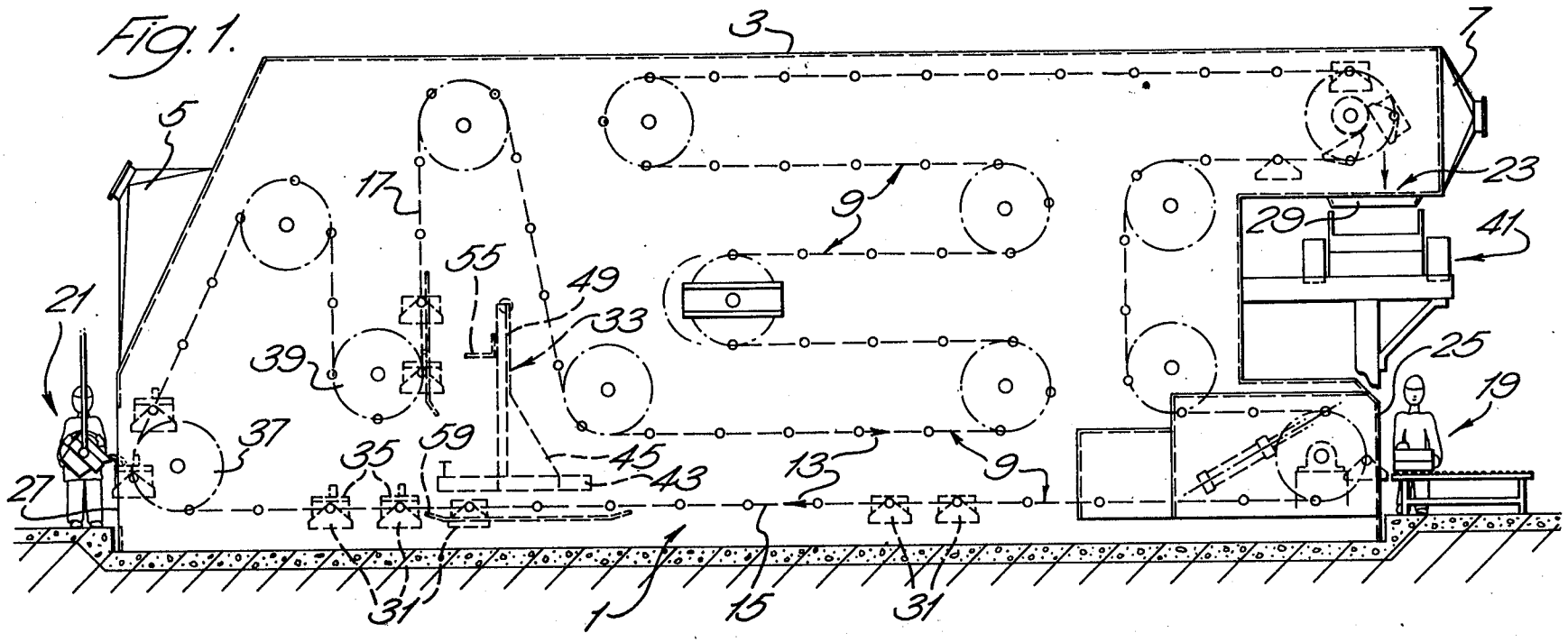
FIG. 1 is a side elevation of a casting machine from one side.
Figure 2:
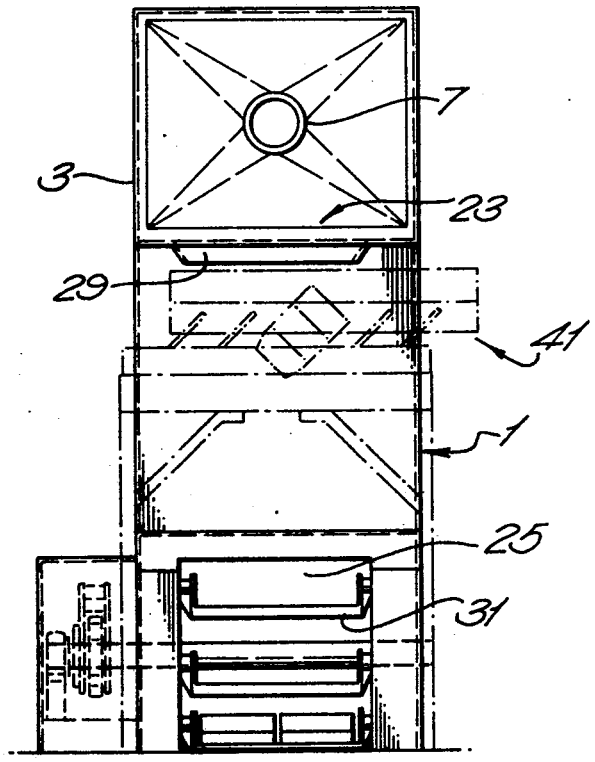
FIG. 2 is an end elevation looking in the direction of the arrow A of FIG. 1.
Figure 3:
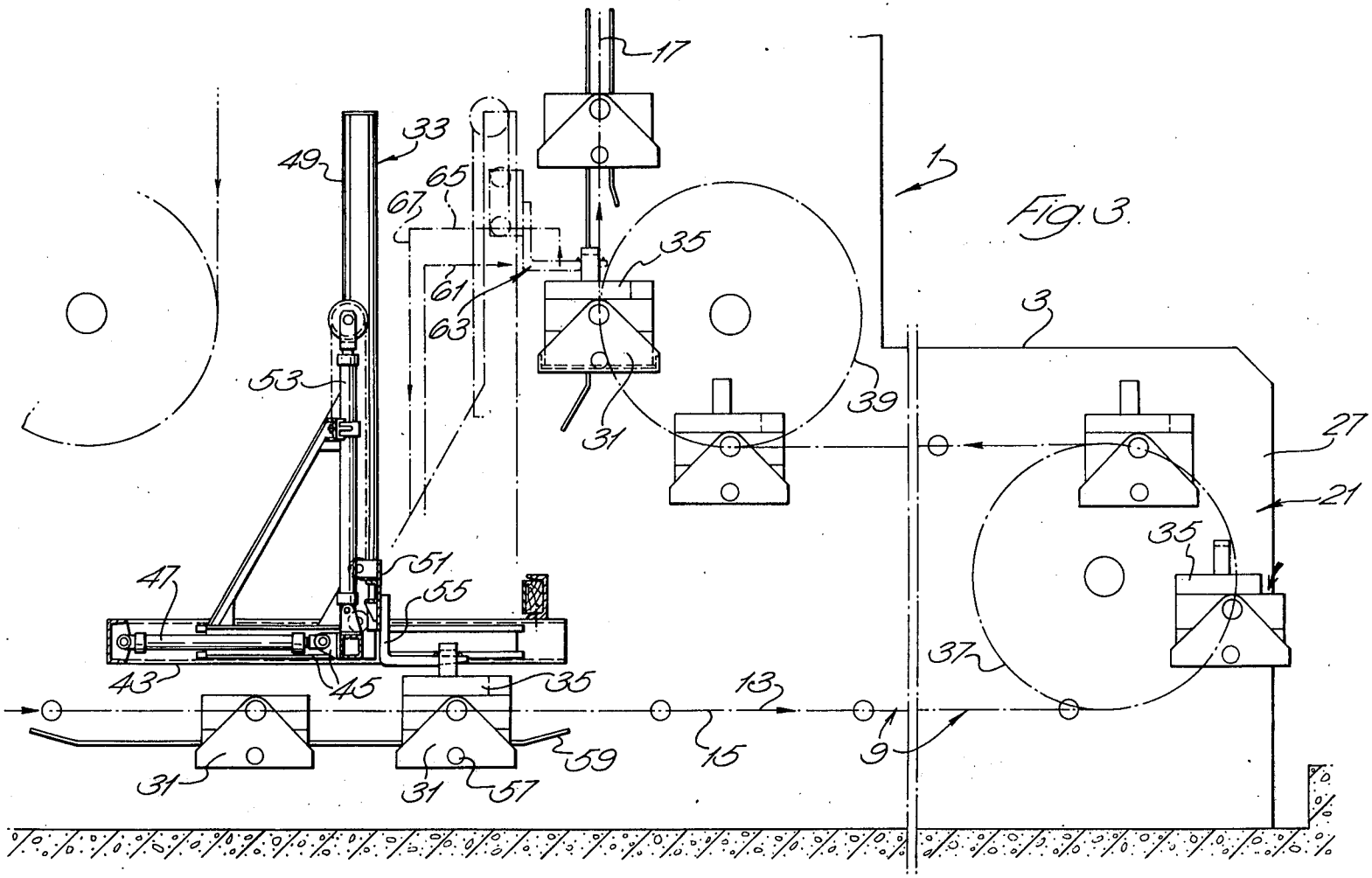
FIG. 3 is an enlarged side elevation of a slightly modified construction of machine showing the pouring station and mould transfer device, the view being from the opposite side to that of FIG. 1.

Referring to FIGS. 1–3 of the drawings, a casting machine is shown generally at 1 and has an overall casing 3 for confining fumes and dust, and extraction units 5 and 7. An endless conveyor 9, e.g. a twin chain conveyor, is entrained around a plurality of pairs of sprocket wheels located in the same vertical plane within the casing 3. The conveyor is advanced step by step in the direction of the arrows 13 and has a lower horizontal run 15 and several vertical runs including the vertical run 17. The machine is provided with a mould loading station 19, a metal pouring station 21 and a mould discharge station 23 and hence the casing is provided with openings 25, 27 and 29 at the three respective stations.

A plurality of trays or containers 31 are supported on the conveyor 9 at regularly spaced intervals. After the trays 31 have been loaded with one or more moulds by an operator at the station 19, the conveyor is indexed until the moulds pass beneath a weight transfer device 33 where a weight 35 is placed upon each mould on the respective trays. The moulds are of the green sand type and are preferably flaskless, i.e. there is no mould box, and it is therefore essential that weights are placed on the moulds prior to the pouring of molten metal to prevent the moulds from breaking open. After the placing of the weights on the mould the trays are carried around a pair of sprockets 37 at the station 21 and molten metal is poured into the moulds, whereupon the moulds are advanced step by step until they pass around a further pair of sprockets 39 and reach the vertical run 17 of the conveyor. At the bottom of this run the weights are removed by the weight transfer device 33, whereupon the cast moulds are further advanced in a sinuous path through the machine until they are eventually tipped automatically from the trays at the discharge station 23 onto screening apparatus 41 where the castings are separated from the moulding sand in known manner and, if necessary, from the mould boxes. The sand can then be re-processed and used again for subsequent moulds which will then be presented to the operator at the station 19.

In the construction shown in FIG. 3, the endless conveyor is entrained about sprockets (unnumbered) adjacent the mould loading station 19 and, after passing along the horizontal run 15 and over the sprocket wheels 37, passes directly over the sprocket wheels 39 without an intermediate pair of sprocket wheels, to the vertical run 17. In every other respect it is similar to the construction shown in FIG. 1 and the weight transfer device 33 is substantially identical. The weight transfer device 33 is located just above the horizontal conveyor run 15 and is fixed to the frame (not shown) of the machine and includes a horizontal guide track 43 in which a carriage 45 runs under the control of a double-acting single-step ram 47. Supported on the carriage 45 is a vertically extending mast or a pair of vertically extending masts 49 on which a vertically movable carriage 51 is supported for vertical movement under the control of a further ram 53. The carriage 51 supports suitable mould lifting means which, as illustrated, comprise a pair of L-shaped forks 55. As the trays 31 are indexed forward beneath the transfer device 33 they will be held steady by a guide roller 57 engaging a guide track 59.

Advance of the conveyor and operation of the transfer device 33 are synchronised so that when the carriage 45 is in its withdrawn illustrated position, a weight 35 supported on the forks 55 is arranged directly above a mould on the tray 31. The next indexing or advancing step of the conveyor 9 will cause the weight to be disengaged from the forks 55 so that it is then advanced with the mould on its tray 31. As soon as this has happened, the ram 53 is operated to move the carriage 51 from its lower illustrated position to an upper position shown at 61, whereupon the ram 47 is operated to move the carriage 45 and hence the mast 49 forwardly to the position shown at 63 where the forks 55 will engage with a weight 35 on a tray 31 located at the bottom of the vertical conveyor run 17. The ram 53 is then operated again to raise the carriage 51 to the position shown at 65 thus lifting the weights 35 off the moulds on the tray at the bottom of the run 17, whereupon the ram 43 is operated again to retract the carriage 45 and mast 49 to the position shown at 67 so that the ram 53 can then subsequently lower the carriage 51 and the weights back to the illustrated position so that the weight can be placed upon the mould or moulds on the next tray 31 as they are advanced beneath and then beyond the forks 55. This operating sequence is repeated as necessary.

Although the present invention can be used with conventional green sand moulds having mould boxes, in which case of course the mould boxes have to be separated out from the casting, it is specifically designed for flaskless green sand moulds in which the sand in the two mould parts is chemically bonded together.

Although the weight transfer device 33 is shown with lifting forks 55 and hydraulically operated rams, many other different constructions are possible. For example, the weights could be lifted off the moulds by an electromagnetic device and the various carriages could be operated by chain or belt drives and electric motors or in any other known manner. We have found, however, that hydraulic rams in conjunction with L-shaped forks which engage beneath hoops carried on the weights are quite satisfactory.

Normally, the conveyor will be indexed forward automatically and operated in synchronisation with the device 33 largely automatically, the indexing being equivalent to the spacing between trays on the conveyor, but there will be a master switch at least at the pouring and mould assembly stations so that if the operator at either of these stations gets into difficulties, he can control the indexing of the conveyor and hence operation of the transfer device 33.

In the machine described above, the trays are unloaded automatically by being tipped at the discharge station 23. In some instances, however, depending upon the nature, size and shape of the castings, the tipping step may be omitted and the moulds may be removed from the trays by hand, in which case it would preferably be arranged for the conveyor to be stopped as each tray arrives at the discharge station 23. Instead of being removed by hand, the moulds could of course be removed mechanically, automatically or semi-automatically.

In the two described embodiments, the vertical run of the conveyor in which the weights are removed from the moulds on the trays is the first vertical run. This is not essential and if it is desired to give the castings a greater cooling time before the weights are removed, then there could be several up and down runs or to and fro runs of the conveyor prior to weight removal.

Figure 4:
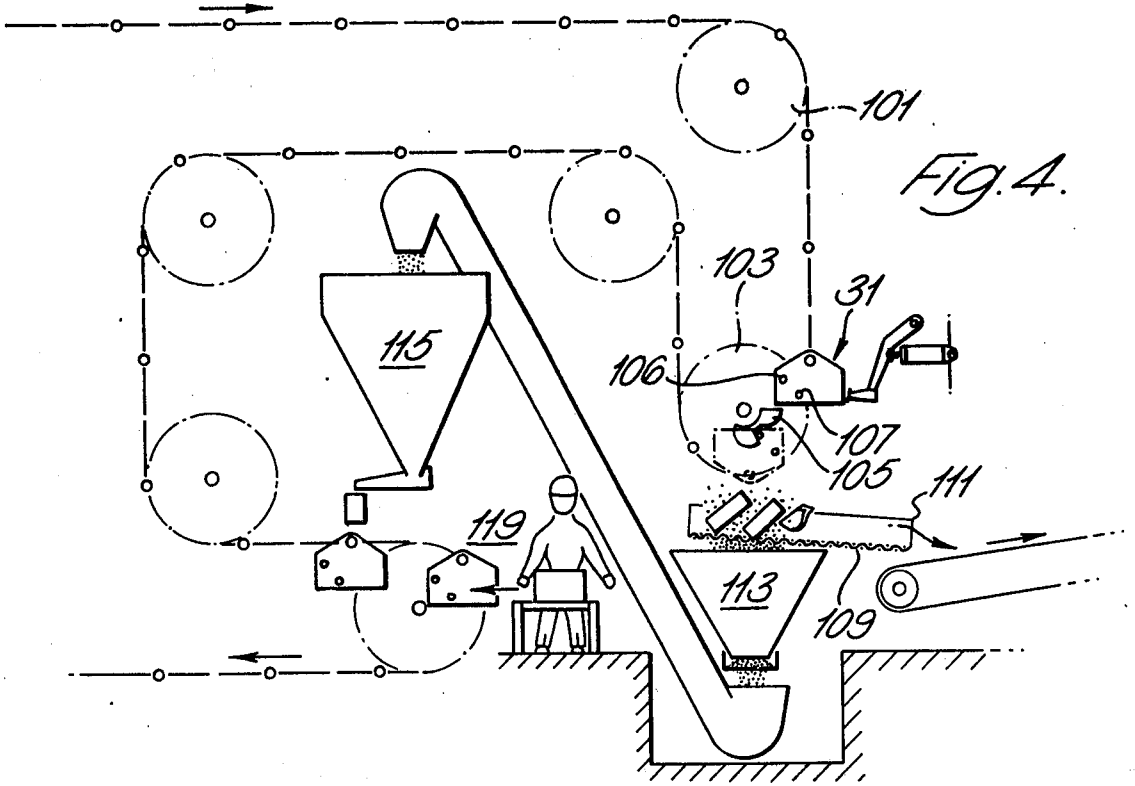
FIG. 4 is a schematic representation of an alternative construction of foundry machine.

It is sometimes advantageous to discharge the contents of the trays 31 at a low level rather than a high level as shown in FIG. 1. This is especially the case when the castings are heavy and thus have considerable inertia when tipped from a height. When low level discharge is required, the moulds, after cooling, pass around high level sprocket wheels 101 (see FIG. 4) and are tipped and discharged as they pass around low level sprocket wheels 103, a suitable tipping cam 105 engaging successively rollers 106 and 107 on the end face of the trays 31. Each of these rollers 106 and 107 causes the tray to tip through approximately 90° so that the mould castings and sand tip onto a screen 109. The moulds, mould sand, and the castings pass off the screen 111 to another station and the bedding sand passes through the screen and into a hopper 113 from which it is elevated into a hopper 115 ready for bedding moulds at the tray loading station 119.

Figure 5:
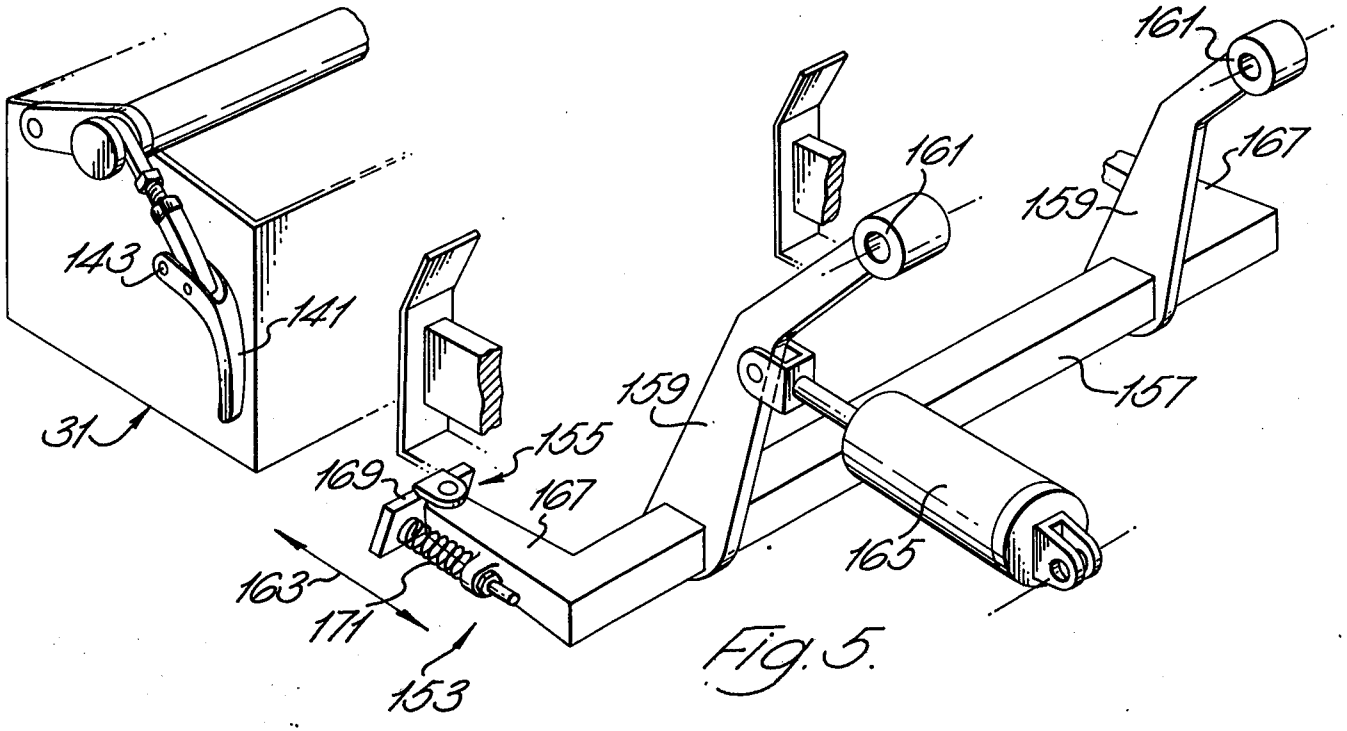
FIG. 5 is a partially schematic perspective view of mould clamp latching and unlatching mechanism used in conjunction with horizontally split moulds.
Figure 6:
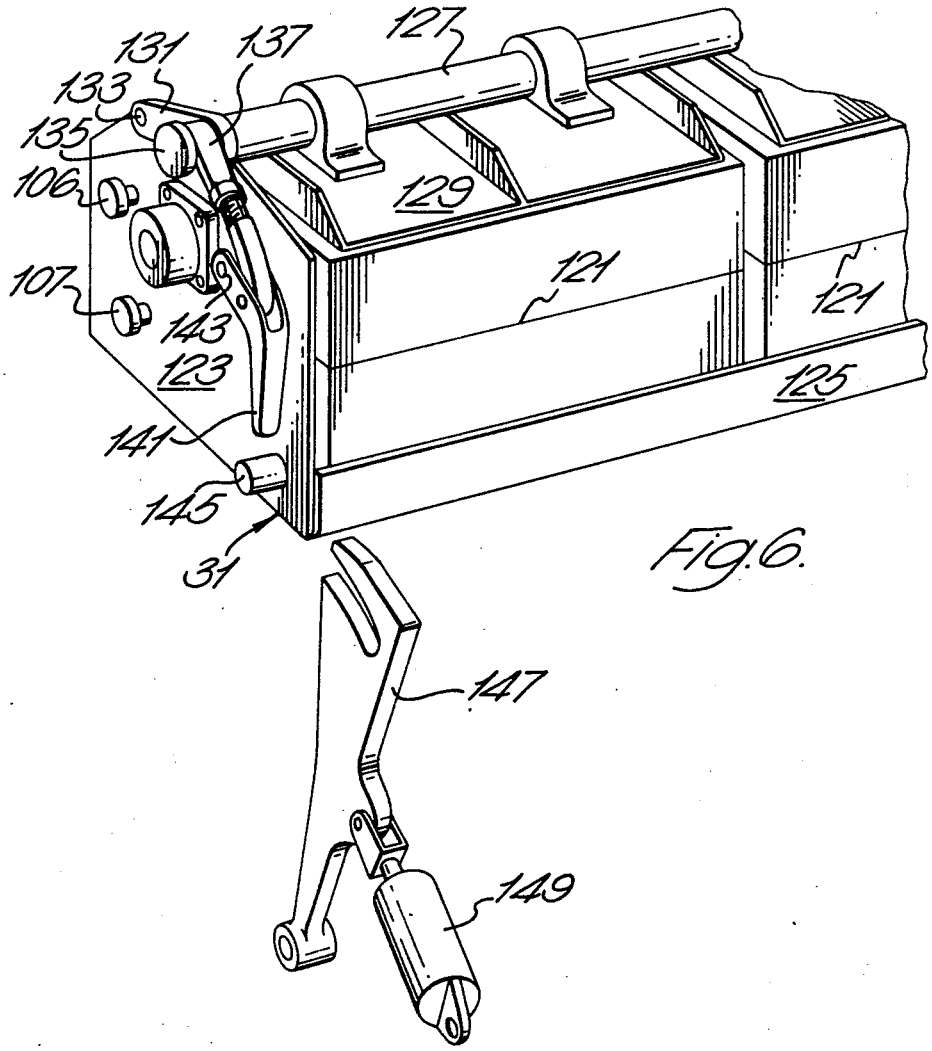
FIG. 6 is a further view similar to FIG. 5 of the mould clamping mechanism.
Figure 7:
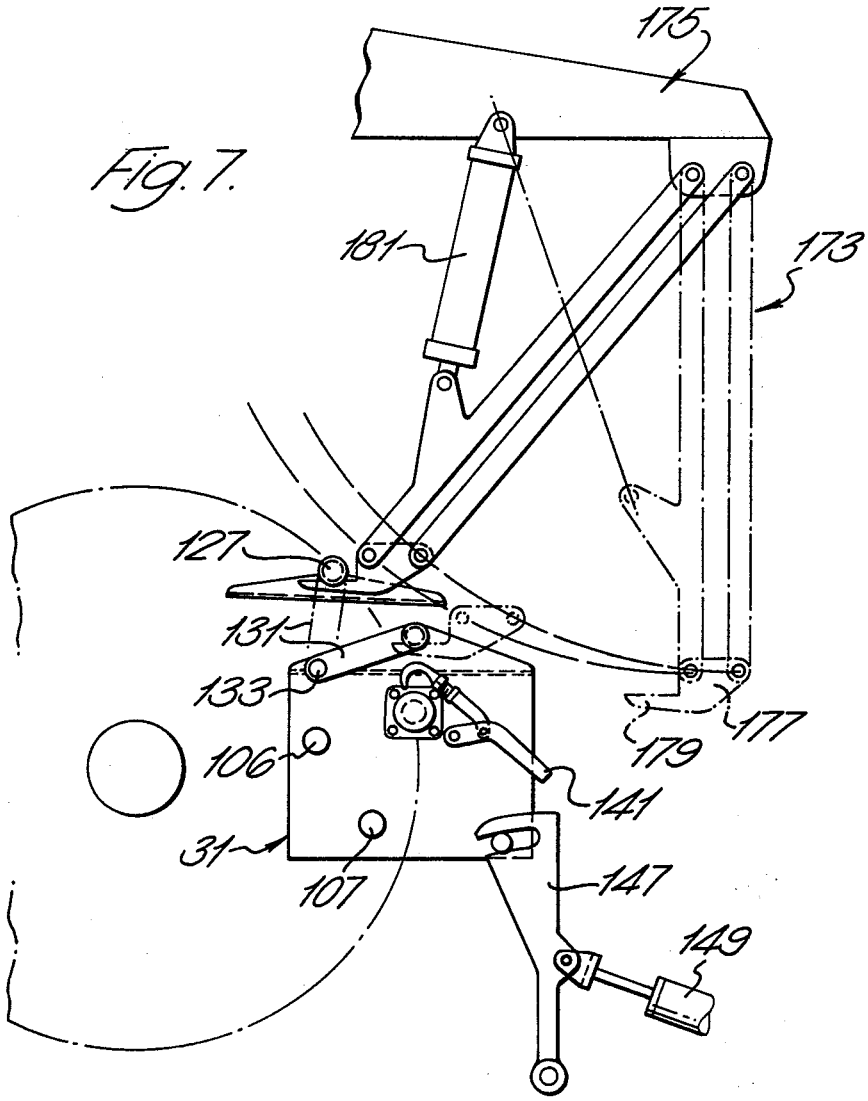
FIG. 7 is an end elevation of a typical clamp plate lifting mechanism for the construction shown in FIGS. 5 and 6.

If it is desired to clamp the two mould parts together rather than place weights upon them, clamping mechanism such as shown in FIGS. 5, 6 and 7 or FIG. 8 can be used. In FIGS. 5, 6 and 7 mechanism for clamping and releasing mould parts split horizontally, for example at 121, is used. The trays indicated generally at 31 having upstanding end walls 123 and a front bar 125 (see FIG. 6) to locate the moulds in position. This front bar may be loose or removable to provide for cleaning following possible spillage during pouring. Extending between the two end plates 123 of each tray 31 is a clamp plate support tube 127 on which a plurality of freely pivoted clamp plates 129 are supported. The tube 127 is pivotally mounted at each end on the end of a pivot arm 131, the opposite end of which is pivotally connected to a plate 123 at 133. The ends of the support tubes 127 project outwardly of the arms 131 a short distance, these projecting ends terminating in circular end flanges 135 having overall diameters somewhat greater than the projecting portions of the tube 127.

To maintain the clamp plates 129 in the clamping position shown in FIG. 6, the hook portion of a hook 137 engages over each projecting portion of the tube 127, the hook having its opposite end pivotally connected to a central portion of a generally L-shaped level 141 forming part of an over-centre locking device. One end of lever 141 provides a handle, whereas its other end is pivotally connected to the plate 123 at 143. Preferable, a suitable adjustment device of known construction is provided between the operative end of the hook 137 and the lever 141 to adjust the clamping force provided by the hook 137.

To load the trays 31 with moulds, it is necessary for the clamp plates 129 to be in a release position and for the tray 31 to be held stationary and prevented from tipping. A mechanism for achieving this is shown in FIGS. 6 and 7. At a lower corner of each end plate 123, a projecting pin 145 is provided which is engageable by a claw 147 fixed to the frame of the foundry machine and movable by a piston and cylinder device 149. When this is moved to the engaged position shown in FIG. 7, the tray is held steady and the claw 147 is shown in its released position for tipping of the tray in FIG. 6.

To release the clamp plates prior to lifting them off (FIG. 7) an unlatching mechanism 153 is provided (see FIG. 5). The mechanism 153 is secured to the machine frame and includes two release devices 155 supported on the end of a bar 157 mounted on the free ends of two arms 159, the other ends of which are pivotally connected to the machine frame at 161. The release devices 155 are moved generally in the direction of the arrows 163 by a suitable piston and cylinder device 165 connected between one of the arms 159 or the bar 157 and the machine frame. The release devices 155 are mounted on the end of legs 167 projecting forwardly from the bar 157 and include a plate 169 pivotally connected at its centre to the leg 167 and biased by a spring 171 to a lever engaging position as illustrated, in which position it extends transverse to the leg 167. Plates 169 are constructed so that they can pivot in one sense beyond the illustrated position but they can pivot in the other sense through 90° so as to fold against the leg 167 and extend the spring 171 when pressure is applied to their outer face on the side opposite the spring 171. Each plate 169 has its inner end portion aligned with a lever 141 so that when the piston of the piston and cylinder device 165 is extended, the inner end portion of the plate 169 will strike the handle portion of the lever 141, the plate will rotate through 90° so that the device 155 can pass the lever 141 and as soon as it has passed, the plate 169 will spring back so as to extend at right angles to leg 167 again, so that when the piston 165 is retracted, a rear face of the plate 169 will engage the handle portion of the lever 141, causing the lever to rock about its pivot point 143 and disengage the hook 137 from the projection on the end of the tube 127, thus unclamping the clamps.

In order to remove the clamp plates 129, for example for loading moulds onto the trays, a mechanism such as that shown in FIG. 7 is provided. This includes a parallelogram linkage device 173 secured to the machine frame 175 and supporting a lifting shoe 177 having a toe 179 for engagement beneath the support tube 127. The mechanism is moved between its inoperative position shown in broken lines and its lifting position shown in full lines by a hydraulic piston and cylinder device 181 connected between one of the arms of the linkage and the machine frame.

Figure 8:
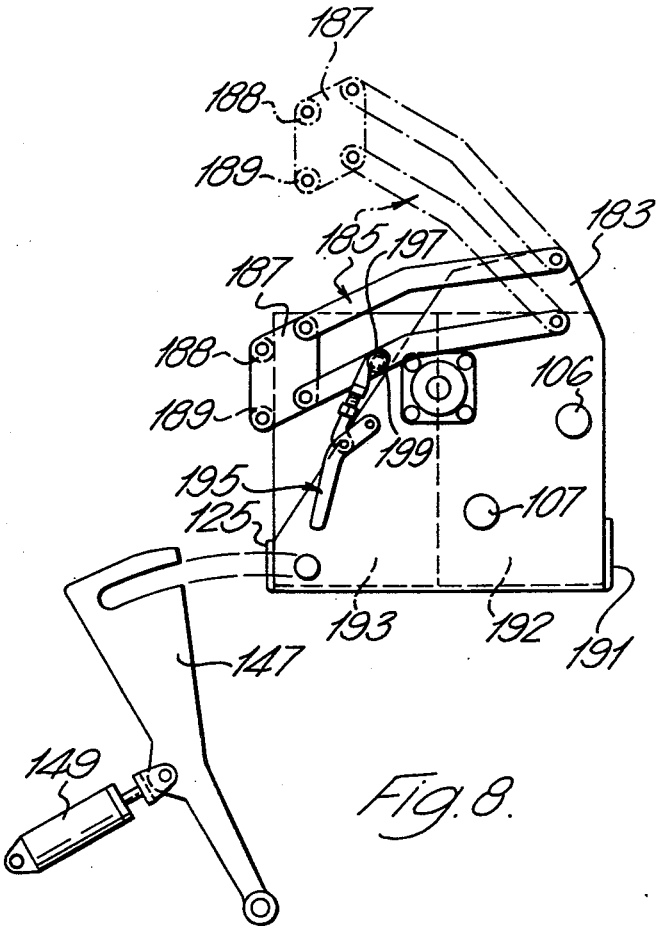
FIG. 8 is an end view of an alternative construction of clamping mechanism for vertically split moulds.

The tray clamping mechanism for vertically split moulds is illustrated in FIG. 8. The mould trays are slightly modified from those shown in FIGS. 5 and 6 although like parts are identified by the same reference numerals as used for the corresponding parts of the FIGS. 5 and 6 construction. The side walls of the trays include an upwardly projecting portion 183 to which are pivotally connected the ends of two arms forming part of a parallelogram linkage 185. These arms are cranked and at their opposite ends are pivotally connected to a plate 187 and extending between the plates 187 forming part of the linkage at each end of the tray are two bars 188, 189. The tray includes a short upstanding rear wall 191 against which one half-mould 192 sits, the other mould half being shown at 193. When it is desired to clamp the two mould halves together, the linkage 185 is moved from its broken line position to its full line clamping position so that the two bars 188 and 189 bear against the front face of the mould half 193, thus pressing it against the mould half 192. When in this position, an overcentre locking device 195 similar in construction to the device 141 is brought into operation so that a hook 197 forming part of the device can engage with a projecting stud 199 on one of the arms of the linkage. When it is desired to release the clamps, the device 195 is released so as to release the hook 197 from the studs 199, and the linkage can then be moved to its broken line position. The linkage could be spring biased to this position or could be so arranged as to be lifted to this position and held there by a suitable locking catch.

It will be appreciated that the clamps both for the vertically split and horizontally split moulds will have to be released prior to tipping of the trays for discharge of the moulds and their contents therefrom. Actual movement of the clamps to their release position will then occur automatically, largely due to the weight of the moulds on the trays, when the trays are tipped through 180°.

I claim:

1. A foundry casting machine comprising a frame, means supporting an endless conveyor on said frame, for movement in a vertical plane through a sinuous path, an overall casing surrounding said frame and endless conveyor, means supporting a plurality of suspended trays on said endless conveyor, three openings in the exterior of said casing, drive means for driving said conveyor, and hence said trays, successively past said openings, said openings comprising a first opening providing access to successive trays for the assembly of one or more moulds therein from two mould parts, a second opening at a pouring station providing access to the trays for the pouring of molten metal into the moulds, a third opening through which the contents of the trays may be removed, air extraction means adapted to withdraw air and air-borne particles from the interior of said casing and from the vicinity of the second and third openings for passage through a filtration plant, means including at least one weight to hold together said mould parts prior to a pouring operation, a forklift type unit for placing a weight on said moulds on the trays as they pass along a lower conveyor run prior to a pouring operation and for subsequently removing said weight from the moulds as they enter a section of the conveyor run which continues vertically upwards subsequent to said pouring operation, said forklift type unit having a horizontal guide track, a horizontally movable carriage supported on said guide track, a vertically extending mast supported by said carriage, a vertically movable carriage movable along said mast, and lifting means supported on said vertically movable carriage for engaging said weight.

2. A foundry casting machine as claimed in claim 1 including means for removing said moulds automatically from said trays at said third opening, and further means at the third opening for tipping said trays over as they pass said opening.

3. A foundry casting machine as claimed in claim 1 including two pairs of horizontally spaced sprocket wheels, one pair of said sprocket wheels being at the pouring station and another pair of said sprocket wheels being at a mould assembly station, and beneath and around which said endless conveyor is entrained to define its lower run, at least one further pair of sprocket wheels above and between the said two pairs of sprocket wheels, said conveyor being entrained beneath and around said at least one further pair of sprocket wheels so as to return parallel to the lower run and then continue vertically upwards, the pouring occurring at the outermost extent of the pair of sprocket wheels at the pouring station.

4. A foundry casting machine as claimed in claim 1 wherein said lifting means comprises a pair of lifting forks.

5. A foundry casting machine as claimed in claim 1 wherein the forklift unit is located so that its horizontal guide track extends towards said pair of sprocket wheels at said pouring station and said mast extends parallel to said vertically extending conveyor run and it is so arranged that, in a typical operating sequence with said conveyor stationary said vertically extending carriage will rise from its lowermost position to an upper position whereupon said horizontally movable carriage will be moved forwards so that said lifting means can be moved into engagement with suitable hoops on weights located on said moulds on a tray moving up the vertically extending run of the conveyor, whereupon said vertically movable carriage will be moved upwards to an uppermost position to remove said weights from said moulds, and said horizontally movable carriage will then be returned to its initial position to move said weights out of the path of said conveyor, said vertically movable carriage then being lowered to its original position so as to place said weights on to another mould located beneath it on said horizontal run of said conveyor, said conveyor then being automatically indexed forward to remove said weights from off said lifting means, whereupon the cycle of operations is repeated.

6. A foundry casting machine as claimed in claim 5 wherein said horizontally and vertically movable carriages are operated by double acting single step hydraulic lifting and traversing rams.

7. A foundry casting machine comprising a frame, means supporting an endless conveyor on said frame, for movement in a vertical plane through a sinuous path, an overall casing surrounding said frame and endless conveyor, means supporting a plurality of suspended trays on said endless conveyor, three openings in the exterior of said casing, drive means for driving said conveyor, and hence said trays, successively past said openings, said openings comprising a first opening providing access to successive trays for the assembly of one or more moulds therein from two horizontally split mould parts, a second opening at a pouring station providing access to the trays for the pouring of molten metal into the moulds, a third opening through which the contents of the trays may be removed, air extraction means adapted to withdraw air and air-borne particles from the interior of said casing and from the vicinity of the second and third openings for passage through a filtration plant, a clamping mechanism forming part of each said tray to hold each mould together, said clamping mechanism including a clamp plate support tube between said end walls above said moulds on said tray for movement between clamping and release positions, a clamp plate for each mould, means freely supporting said clamp plates on said tube, and operating means for moving said tube and hence said clamp plate(s) between said clamping and release positions.

8. A foundry casting machine as claimed in claim 7, wherein said operating means including a hook for engaging a projecting end of said tube, a lever pivotally connected to its respective upstanding end wall, and means pivotally connecting said hook to a central portion of said lever, said lever providing an over centre locking device.

9. A foundry casting machine as claimed in claim 8, including an unlatching mechanism for said clamp plate(s), and means for preventing said trays from tipping.

10. A foundry casting machine as claimed in claim 9, wherein said unlatching mechanism includes a release device supported on the end of a bar mounted on the free end of two arms, the other ends of which are pivotally connected to said frame and pivoted by a drive means, said release device comprising a spring loaded plate engageable with said lever for pivoting said lever on withdrawal of said bar by said drive means to release said hook from said projecting end of said tube.

11. A foundry casting machine as claimed in claim 7 including a parallelogram linkage for removing said clamping plate(s) to enable mould(s) to be loaded onto said tray, said linkage having two arms pivotally connected to said frame at spaced intervals and the opposite ends of said arms connected to a lifting toe engageable beneath said tube, and means extending between one of said arms and said frame to move said arms and hence said toe between inoperative and lifting positions.

12. A foundry casting machine comprising a frame, means supporting an endless conveyor on said frame, for movement in a vertical plane through a sinuous path, an overall casing surrounding said frame and endless conveyor, means supporting a plurality of suspended trays on said endless conveyor, three openings in the exterior of said casing, drive means for driving said conveyor, and hence said trays, successively past said openings, said openings comprising a first opening providing access to successive trays for the assembly on one or more moulds therein from two vertically split mould parts, a second opening at a pouring station providing access to the trays for the pouring of molten metal into the moulds, and a third opening through which the contents of the trays may be removed, air extraction means adapted to withdraw air and air-borne particles from the interior of said casing and from the vicinity of the second and third openings for passage through a filtration plant, a clamping mechanism forming part of each tray to hold each mould together, said clamping mechanism including two parallelogram linkages each having a pair of parallel cranked arms and each pivotally connected to one of said end walls at one end, the opposite ends of the arms of each linkage being pivotally connected to a plate forming part of the linkage, at least one bar extending between said plates above said tray, an upstanding rear wall on said tray, and an over centre locking device having a hook associated therewith for engagement with a stud on one of said arms for locking said mechanism in a clamping position.

13. A foundry casting machine as claimed in claim 12, including spring means for biassing said clamping mechanism to a release position when said hook is disengaged from said stud.

14. A foundry casting machine as claimed in claim 12 including means for preventing said tray from tipping.

* * * * *